United States Patent [19]

Miyanaka et al.

[11] Patent Number: 4,474,548

[45] Date of Patent: Oct. 2, 1984

[54] COMBUSTION CONTROLLING APPARATUS

[75] Inventors: Motoshi Miyanaka; Kenzi Toudo, both of Yanai, Japan

[73] Assignee: Hitachi, Ltd., Tokyo, Japan

[21] Appl. No.: 387,525

[22] Filed: Jun. 11, 1982

[30] Foreign Application Priority Data

Nov. 13, 1981 [JP] Japan ..... 56-181128

[51] Int. Cl.[3] ..... F23N 5/12

[52] U.S. Cl. ..... 431/1; 431/25; 431/78; 340/579; 363/22

[58] Field of Search ..... 431/1, 25, 78; 307/117; 328/6; 340/577, 579; 60/39.77; 363/18-23; 331/113 R

[56] References Cited

U.S. PATENT DOCUMENTS 3,041,589 6/1962 Dietz ..... 340/579

FOREIGN PATENT DOCUMENTS 2001426A 1/1979 United Kingdom ..... 431/78

OTHER PUBLICATIONS

Thomas Roddam, *Transistor Inverters and Converters,* Princeton, N.J., D. Van Nostrand Company, Inc., 1963, pp. 80, 126-129, 173.

Jerome E. Oleksy, *Practical Solid-State Circuit Design,* Indianapolis, Ind., Howard W. Sams & Co., Inc., 1974, pp. 132-133.

*Primary Examiner*—Lee E. Barrett

*Attorney, Agent, or Firm*—Antonelli, Terry & Wands

[57] ABSTRACT

A combustion controlling apparatus is disclosed which is used in a pulse combustion apparatus for generating flames intermittently and which has a flame-rod type flame detector. In this combustion controlling apparatus, a low AC source voltage is converted to a DC voltage and then this DC voltge is converted by an inverter to an AC of about 100 V and 800 Hz which is then supplied to the igniter and flame rod. The inverter comprises a pair of transistors and a transformer having a primary winding with its center tap connected to a DC source voltage and both ends thereof connected to the respective collectors of the transistors which are in turn cross-coupled to the bases of the mating ones through respective series circuits each consisting of a capacitor and a resistor. Thus, in a secondary winding of the transformer, a rectangular wave voltage is produced. The inverter can supply a high voltage to the flame rod during ignition, enabling easy fire detection and can prevent the transistors from generating heat. Moreover, the combustion controlling circuit and fuel valve driving circuit are supplied with power from the inverter, and thus safety is improved.

12 Claims, 4 Drawing Figures

COMBUSTION CONTROLLING APPARATUS

BACKGROUND OF THE INVENTION

This invention relates to a combustion controlling apparatus having an igniter circuit and a flame-rod type flame detecting circuit, and particularly to one which is powered by a low voltage AC source and used for a pulse combustion apparatus.

The low voltage AC source is for example, a 24-volt source.

The pulse combustion apparatus is different from the ordinary combustion apparatus in which a flame of combustion is continuously present as time elapses, in that it generates flames intermittently, or in a pulse like manner. One of the various types of known pulse combustion apparatus, for example, has a combustion chamber, a valve for controlling gaseous fuel and air to be supplied to the combustion chamber, and a discharging tube so designed as to cause a resonant oscillation in the tube of a predetermined period in cooperation with the combustion chamber. In general, the combustion chamber and the discharging tube constitute a heat exchanger. In operation, a fuel-air mixture is supplied through the valve to the combustion chamber, where it is ignited by an igniter to be burnt explosively. Under the pressure produced by the explosive combustion, the valve is closed, while the burnt gas is discharged through the discharging tube. Due to the discharge of the exhaust gas a negative pressure prevails in the combustion chamber, whereby the valve is opened to again such in the gaseous fuel and air on one hand. On the other hand, the resonant oscillation in the tube produced through the cooperation of the combustion chamber and discharging tube causes the remaining combustion flame or high temperature gas in the discharging tube to return to the combustion chamber, so that the sucked air-fuel mixture is explosively burnt by the remaining combustion flame or high temperature gas. This increased pressure causes the previous exhaust gas to discharge. This operation as one cycle of combustion is repeated in succession. That is, the combustion is performed intermittently, or in a pulse-like manner.

The frequency of this pulse combustion is generally 50 Hz to 80 Hz.

In the flame-rod type flame detecting circuit, an AC voltage of about 100 to 150 V is applied between a pair of electrodes which are provided to contact flames, so that the variations in the applied AC voltage caused across the electrodes is detected by the rectifying action of flame. Thus, the variations in the AC voltage can be taken out as a signal representing the presence or absence of flame. Detection of flame is effected during a positive half-wave period of the AC voltage.

Thus, when the commercial AC voltage of 60 Hz is applied to the flame combustion at 50 Hz to 80 Hz, the positive half-wave voltage is not always synchronized with the presence of flame because of no correlation therebetween, and therefore the flame can not be detected. Accordingly, the frequency of the AC to be applied is increased to, for example, about 800 Hz so that the positive halves of the AC are synchronized with the pulse flames.

The conventional combustion control apparatus of the kind mentioned above will be described with reference to FIGS. 1 and 2.

In FIG. 1, an AC voltage from a low-voltage AC power source 1 is converted to a DC voltage by a rectifying circuit 2, and then converted and boosted to a high-frequency AC voltage by an inverter 3 which produces an output of a sinusoidal waveform. The voltage produced from the inverter 3 is applied to an igniting circuit 4 and a flame-rod type flame detecting circuit 5. An igniting electrode 6 ignites a burner 7 and a flame rod 8 detects flames. A control circuit 9 and a fuel valve driving circuit 10 are supplied with power from the rectifying circuit 2, and the control circuit 9 controls the operations of the igniting circuit 4, the fuel valve driving circuit 10 and a fuel valve 11.

The arrangement of FIG. 1 will be described in detail with reference to FIG. 2.

The AC power source 1 is turned on by a thermostat which is actuated depending on the temperature of the load. The rectifying citrcuit 2 is composed of a diode 20 and a capacitor 21. The inverter 3 has an oscillation circuit and a transformer 22, and the oscillator circuit is formed of a capacitor 23, resistors 24 and 25, a transistor 26 and capacitors 27 and 28. The output of the inverter 3 is a sine wave voltage with an amplitude of 100 to 150 V and a frequency of 800 Hz. When a small amount of collector current flows in the transistor 26 because of the fluctuation of source voltage or the like, the transistor 26 is turned on. When the charge on the capacitor 28 is discharged through the transformer 22, the transistor 26 is turned off. Then, when the transistor 26 becomes completely in the off state, it goes to the on-state depending on the time constant circuit of the resistor 25 and capacitor 27. The above operation is repeated.

The igniting circuit 4 includes a pulse generating circuit composed of diodes 30, 31 and 32, resistors 33, 34, 35 and 36, a thyristor 37, a diac 38, capacitors 39 and 40, and a transistor 41. The igniting circuit 4 further includes a pulse transformer 42. When the igniting circuit 4 is operated, the transistor 41 is turned off. The capacitor 39 for charge and discharge is charged through the diode 30. The capacitor 40 is charged through the resistor 34, and when the voltage across the capacitor 40 reaches a value which is large enough to make the diac 38 conductive, the charge of the capacitor 40 flows into the thyristor 37 as a gate current through the diac 38 and the resistor 35 to thereby turn the thyristor 37 on. Then, the charge on the capacitor 39 is discharged through the thyristor 37, the pulse transformer 42 and the diode 31, and therefore a high voltage for ignition is induced. The resistor 33 controls the charged voltage across the capacitor 39 when the igniting circuit 4 is not operating.

The flame detecting circuit 5 comprises capacitors 45 and 46, resistors 48 and 49 and a part of a combustion controlling integrated circuit 50. The AC source voltage for flame detection is applied through the capacitor 45 and rectified by the rectifying action of the flame into a DC current, the AC component of which is removed by the resistors 48 and 49 and the capacitor 46. The resulting DC voltage is applied to a flame signal input terminal 51 of the combustion controlling integrated circuit 50 of the control circuit 9.

The integrated circuit 50 may be, for example, the HA-16605 W made by Hitachi, Ltd., and performs sequence control. When the ignition starts, the integrated circuit 50 causes its output terminals 54 and 55 to be low level to permit a current to be supplied to an electromagnetic coil 56 of the fuel valve, thus fuel being supplied, on one hand, and to cause the igniter circuit 4 to operate on the other hand. When the burner is ignited the output terminal 55 becomes low in its level, so that the transistor 41 is turned on to stop the operation of the igniting circuit 4.

A resistor 58, a capacitor 59 and a zener diode 60 form a power soruce for the integrated circuit 50. Numeral 61 represents a power source input terminal, and 62 a ground terminal.

In this arrangement, since the inverter 3 feeds the secondary output of the transformer 22 back to the primary, the secondary voltage and frequency are changed depending on the value of the secondary load. Therefore, when the igniting circuit 4 is operated, a low voltage is applied to the flame rod 8, and a small flame current is obtained by the application of AC to flame, so that it is difficult to detect the flame during ignition.

Moreover, since a current is caused to always flow into the base of the transistor 26 of the inverter 3, the base current enters the active region of the transistor 26 at a certain time and thus the transistor 26 generates heat due to the collector loss.

Furthermore, since power is supplied from the rectifying circuit 2 to the control circuit 9 and fuel valve driving circuit 10 even if the inverter 3 breaks down, the control sequence progresses and the fuel valve opens despite disabled ignition, resulting in poor safety.

SUMMARY OF THE INVENTION

It is a first object of the invention to provide a combustion controlling apparatus which applies a high voltage to the flame rod during ignition and prevents the inverter from generating heat.

It is a second object of the invention to provide a combustion controlling apparatus capable of improvidng the safety.

According to this invention, a rectangular wave is produced from the inverter, and the secondary output of the transformer of the inverter is prevented from being fed back to the primary.

DESCRIPTION OF THE PREFERRED EMBODIMENTS

Figure 3:
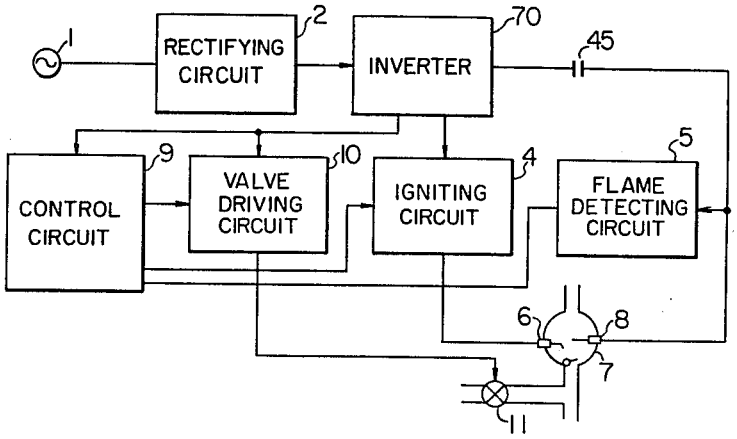
FIG. 3 is a block diagram of an embodiment of a combustion controlling apparatus according to the invention.

A preferred embodiment of this invention will be described with reference to FIGS. 3 and 4. In FIG. 3, an inverter 70 which produces a rectangular wave is provided for supplying an AC current to the igniting circuit 4 and flame detecting circuit 5 and also supplying a low AC voltage to the control circuit 9 and fuel valve driving circuit 10.

Figure 4:
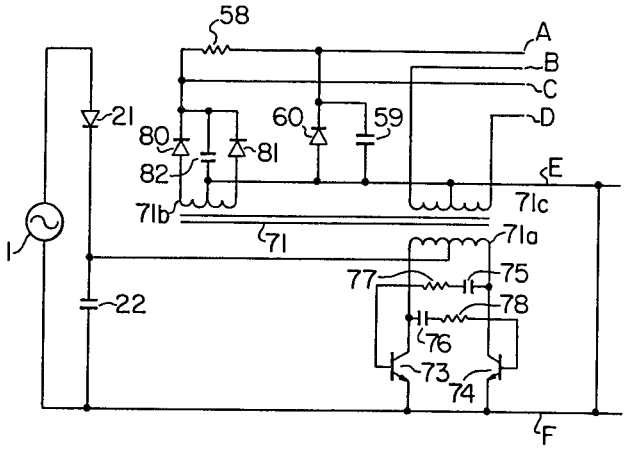
FIG. 4 is a circuit diagram of a main part of the embodiment of the combustion control apparatus according to this invention.

In FIG. 4, a transformer 71 of the inverter 70 comprises a primary winding 71*a*, a secondary low voltage winding 71*b* and a secondary high voltage winding 71*c*. The center tap of the primary winding 71*a* is connected to the DC power source. The oscillation circuit comprises transistors 73 and 74, capacitors 75 and 76, and resistors 77 and 78. There are no starting resistors between the power source and the respective bases of the transistors 73 and 74.

When the transistor 73 starts to become conductive, the collector potential of the transistor 73 decreases and the base of the transistor 74 becomes at a negative potential, so that the transistor 74 is immediately turned off. As this time the transistor 73 is conductive due to the base current flowing to charge the capacitor 75 through the resistor 77, but when the charge current is decreased so that the collector potential of the transistor 73 starts to increase, the transistor 74 becomes conductive and thus the transistor 73 is immediately turned off. In this way, the oscillator continues to oscillate. Even if the trnsistors 73 and 74 are in the off-state from the first, a ripple included in the power source causes the oscillation. Thus, a rectangular wave is induced in the secondary winding.

According to the oscillator, the transistors generate little heat, and therefore there is no need to use power transistors for the oscillator.

An output voltage of about 100 to 500 V is induced in the high voltage winding 71*c* of the transformer 71. The low voltage winding 71*b* is provided with diodes 80 and 81 and a capacitor 82 to form a DC power source.

Figure 1:
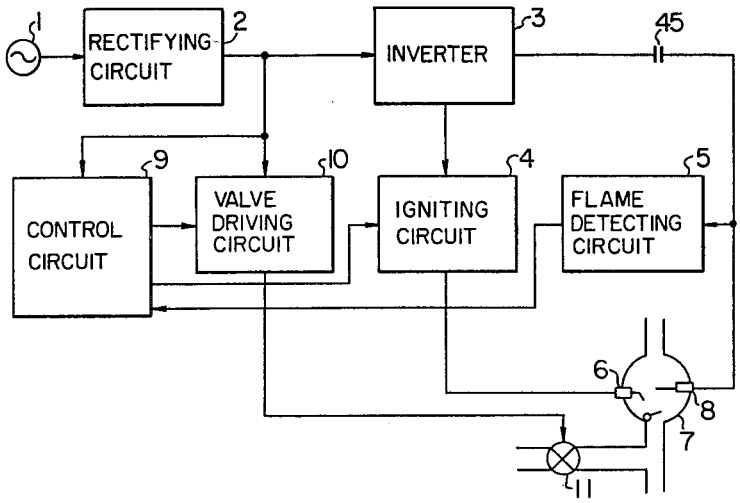
FIG. 1 PRIOR ART
FIG. 1 is a block diagram of a conventional combustion controlling apparatus.
Figure 2:
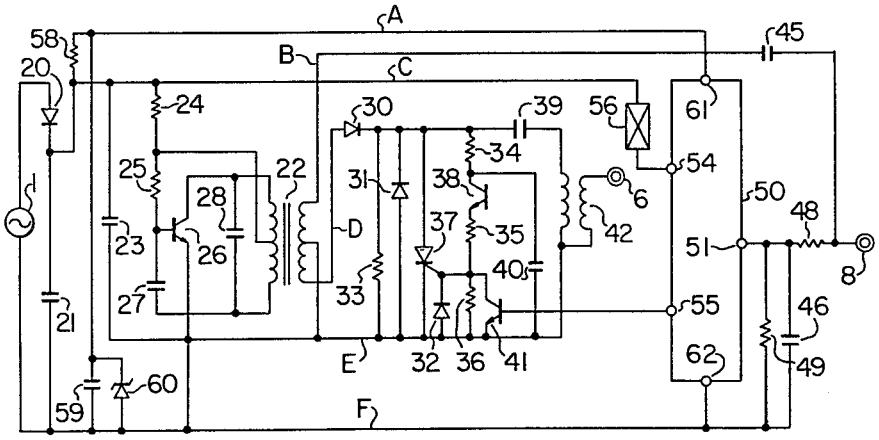
FIG. 2 PRIOR ART
FIG. 2 is a circuit diagram of the conventional combustion controlling apparatus.

The lines A, B, C, D, E and F in FIG. 4 correspond to A to F in FIG. 2. The other circuit arrangements are the same as the conventional circuit arrangement.

Thus, since the inverter 70 is arranged such that the output in the secondary is not fed back to the primary, the output is little affected by the change of the load, or the igniting circuit 4. Therefore, the flame during ignition can be detected by applying a small voltage. Moreover, each of the transistors 73 and 74 is swiftly turned on and off, with little heat generation, and therefore no power transistors are needed for the oscillating circuit.

Also, the inveerter 70 produces a rectangular wave output and therefore it is suitable for the power source to the control circuit 9 and fuel valve driving circuit 10 because the transistors in the inverter 70 generate little heat. This results in the improvement in safety.

According to this invention, flame detection during ignition can be easily performed by application of a low voltage and the inverter 70 is prevented from generating heat. Moreover, since the power to the control circuit 9 and fuel valve driving circuit 10 is supplied from the inverter 70, if the inverter 70 breaks down, power will not be supplied to the fuel valve driving circuit 10 or the sequence control circuit 9. Therefore, fuel will not be provided to the combustion chamber when the inverter is disabled, and this improves the safety of the system.

We claim:

1. A combustion controlling apparatus controlling ignition of fuel in a chamber comprising:

an igniting circuit;

a fuel valve driving circuit for controlling a fuel valve through which fuel is supplied to said chamber;

a sequence control circuit for controlling said igniting circuit and said fuel valve driving circuit;

a flame-rod type flame detecting circuit for supplying its output to said sequence control circuit;

a rectifying circuit for rectifying an AC power into a DC power; and an inverter including means for inverting the output of said rectifying circuit to an AC voltage which is higher in its amplitude and frequency than those of said AC power and which has a rectangular waveform, means for supplying the converted AC voltage to said igniting circuit and said flame-rod type flame detecting circuit, and means for supplying power to at least one of said fuel valve driving circuit and said sequence control circuit so that if a breakdown occurs in said inverter, power will not be supplied to said at least one of said fuel valve driving circuit and said sequence control circuit to prevent the flow of fuel into said chamber through said fuel valve during said inverter breakdown.

2. A combustion controlling apparatus according to claim 1, wherein said inverter comprises a pair of transistors and a transformer having a primary winding with its center tap connected to said rectifying circuit and both ends thereof connected to respective collectors of said pair of transistors, and having a first secondary winding for producing said converted AC voltage to be supplid to said igniting circuit and said flame-rod type flame detecting circuit and a second secondary winding for supplying said power to at least one of said fuel valve driving circuit and said sequence control circuit, the respective collectros of said pair of transistors being cross-coupled to the bases of mating ones through respective series connections each consisting of a capacitor and a resistor.

3. A combustion controlling apparatus according to claim 1, wherein said power supplying means is coupled to provide said power to both said fuel valve driving circuit and said sequence control circuit.

4. A combustion controlling apparatus according to claim 2, wherein said second secondary winding is coupled to provide said power to both said fuel valve driving circuit and said sequence control circuit.

5. A combustion controlling apparatus according to claim 1, wherein said power supplying means in said inverter comprises means for providing DC power to said at least one of said fuel valve driving circuit and said sequence control circuit.

6. A combustion controlling apparatus according to claim 2, further comprising means coupled between said second secondary winding and said at least one of said fuel valve driving circuit and said sequence control circuit to convert an AC voltage at said second secondary winding into a DC voltage to supply DC power to said at least one of said fuel valve driving circuit and said sequence control circuit.

7. A combustion control apparatus comprising:

an igniting circuit;

a fuel valve driving circuit;

a sequence control circuit for controlling said igniting circuit and said fuel valve driving circuit;

a flame-rod type flame detecting circuit for supplying its output to said sequence control circuit;

a rectifying circuit for rectifying an AC power into a DC power;

an inverter including a transformer, said inverter further including means for converting the output of said rectifying circuit to an AC voltage which is higher in its amplitude and frequency than those of said AC power and which has a rectangular waveform;

a first secondary winding of said transformer for supplying the converted AC voltage to said igniting circuit and said flame-rod type flame detecting circuit; and a second secondary winding of said transformer for supplying power to at least one of said fuel valve driving circuit and said sequence control circuit.

8. A combustion controlling apparatus according to claim 7, wherein said second secondary winding is coupled to provide said power to both said fuel valve driving circuit and said sequence control circuit.

9. A combustion controlling apparatus according to claim 7, further comprising means coupled between said second secondary winding and said at least one of said fuel valve driving circuit and said sequence control circuit to convert an AC voltage at said second secondary winding into a DC voltage to supply DC power to said at least one of said fuel valve driving circuit and said sequence control circuit.

10. A combustion control apparatus for controlling ignition of fuel in a chamber comprising:

an igniting circuit;

a fuel valve driving circuit for controlling a fuel valve through which fuel is supplied to said chamber;

a sequence control circuit for controlling said igniting circuit and said fuel valve driving circuit;

a flame-rod type flame detecting circuit for supplying its output to said sequence control circuit;

a rectifying circuit for rectifying an AC power into a DC power;

an inverter including a transformer, said inverter further including means for converting the output of said rectifying circuit to an AC voltage which is higher in its amplitude and frequency than those of said AC power and which has a rectangular waveform;

a first secondary winding of said transformer for supplying the converted AC voltage to said igniting circuit and said flame-rod type flame detecting circuit; and a second secondary winding of said transformer being coupled to supply power to at least one of said fuel valve driving circuit and said sequence control circuit so that if a breakdown occurs in said inverter, power will not be supplied to said at least one of said fuel valve driving circuit and said sequence control circuit to prevent the flow of fuel into said chamber through said fuel valve during said inverter breakdown.

11. A combustion controlling apparatus according to claim 10, wherein said second secondary winding is coupled to provide said power to both said fuel valve driving circuit and said sequence control circuit.

12. A combustion controlling apparatus according to claim 10, further comprising means coupled between said second secondary winding and said at least one of said fuel valve driving circuit and said sequence control circuit to convert an AC voltage at said second secondary winding into a DC voltage to supply DC power to said at least one of said fuel valve driving circuit and said sequence control circuit.

* * * * *